United States Patent [19]

Fujiwara et al.

[11] 4,325,338

[45] Apr. 20, 1982

[54] PRESSURE-RESPONSIVE IGNITION TIMING CONTROLLER FOR A SUPERCHARGED INTERNAL COMBUSTION ENGINE

[75] Inventors: Hiroshi Fujiwara; Kazutoshi Kobayashi; Shinichi Miyo, all of Katsuta, Japan

[73] Assignee: Hitachi, Ltd., Tokyo, Japan

[21] Appl. No.: 171,269

[22] Filed: Jul. 22, 1980

[30] Foreign Application Priority Data

Jul. 25, 1979 [JP] Japan ..... 54-93736

[51] Int. Cl.[3] ..... F02P 5/04

[52] U.S. Cl. ..... 123/407; 123/406

[58] Field of Search ..... 123/146.5 R, 146.5A, 123/406, 407, 418; 92/92, 95, 96, 99

[56] References Cited

U.S. PATENT DOCUMENTS 3,601,105 8/1971 Cooksey ..... 123/407
3,612,019 10/1971 Okamoto et al. ..... 123/146.5 A X
4,242,996 1/1981 Urbansky ..... 123/407

FOREIGN PATENT DOCUMENTS 42-8248 4/1967 Japan .

*Primary Examiner*—Tony M. Argenbright
*Attorney, Agent, or Firm*—Craig and Antonelli

[57] ABSTRACT

An ignition timing controller for a supercharged internal combustion engine is mounted on a distributor housing and has a diaphragm responsive to variations in the pressure in the intake passage of the engine. The diaphragm carries a rod operatively connected at one end to an ignition signal generating means disposed in the distributor housing. When the pressure in the intake passage is increased beyond the atmospheric pressure level, the diaphragm is deformed in the ignition timing retarding direction against a compression coil spring, whereas when the pressure in the intake passage is decreased beyond the atmospheric pressure level, the diaphragm is deformed in the ignition timing advancing direction against another compression coil spring or springs. All the springs are disposed on the side of the diaphragm remote from the distributor housing whereby the strokes of the rod and the set loads of the springs on the diaphragm can be easily adjusted after the ignition timing controller is mounted on the distributor housing.

10 Claims, 7 Drawing Figures

PRESSURE-RESPONSIVE IGNITION TIMING CONTROLLER FOR A SUPERCHARGED INTERNAL COMBUSTION ENGINE

BACKGROUND OF THE INVENTION

1. Field of the Invention

The present invention relates to an ignition timing controller for an internal combustion engine and, more particularly, to a pressure-responsive ignition timing controller for a supercharged internal combustion engine.

2. Description of the Prior Art

Ignition timing controllers each responsive to changes of pressure present in that part of the intake passage of a supercharged internal combustion engine which is adjacent to the engine throttle valve to control the ignition timing of the engine were already known, for example, from Japanese patent publication No. 42-8248, published Apr. 7, 1967, and Japanese patent publication No. 46-19213 corresponding to U.S. Pat. No. 3,612,019 issued Oct. 12, 1971 Hisaji Okamoto et al. The ignition timing controller of the above-mentioned class is mounted on a housing of a distributor, which is operative to distribute high voltage current to respective spark plugs of engine cylinders, and cooperates with the conventional ignition signal generator in the distributor housing to control the ignition timing of the engine. For this purpose, the ignition timing controller is provided with a spring-loaded diaphragm which is responsive to the pressure change. In the ignition timing controllers disclosed in the above-mentioned publications, the springs by which the diaphragm is spring-loaded, are disposed on the opposite sides of the diaphragm. Due to this spring arrangement, it is very difficult to conduct a fine adjustment of the ignition timing characteristic of the ignition timing controller, i.e., to finely adjust the pre-set loads of the springs on the diaphragm after the ignition timing controller has once been mounted on the distributor housing.

SUMMARY OF THE INVENTION

It is an object of the present invention to provide a pressure-responsive ignition timing controller for a supercharged internal combustion engine which is simple in construction, compact and light-weighted and in which the ignition timing characteristic can be accurately adjusted even after the ignition timing controller has been mounted on an associated distributor housing.

According to the present invention, there is provided a pressure-responsive ignition timing controller for a supercharged internal combustion engine having a distributor with an ignition signal generating means, comprising:

a diaphragm housing comprising first and second parts secured together along the peripheral edges thereof and having end walls formed therein with substantially coaxial openings, said first part being secured to said distributor;

a diaphragm disposed in said diaphragm housing and cooperative with said first diaphragm housing part to define a first chamber communicated with the atmosphere;

a generally tubular spring casing having a closed outer end and an open inner end with a radially inwardly extending first annular flange defining a central opening therein, the inner end of said spring casing being secured in air-tight manner to the end wall of said second diaphragm housing part so that said central opening in said spring casing is substantially coaxial with the opening in said second diaphragm housing part;

said second diaphragm housing part, said diaphragm and said spring casing cooperating together to define a second chamber pneumatically connected to the intake passage of said engine adjacent to the engine throttle valve so that a signal pressure is applied to said diaphragm;

an elongated rod member axially extending through said diaphragm housing and said spring casing and operatively associated at one end with said ignition signal generating means, said rod member being secured at an intermediate portion to said diaphragm so that said rod is axially movable with said diaphragm when the same is axially deformed by the pressure change in said second chamber, the other end of said rod being disposed in said spring casing, said rod member having an annular shoulder formed thereon between said diaphragm and the other end of said rod and directed toward said other end;

a first spring retainer means mounted in said spring casing adjacent to the inner end thereof and having a radially outwardly extending first annular section and a radially inwardly extending second annular section defining therein a central opening substantially coaxial with the opening in said inner end of said spring casing, said first spring retainer means being axially movable relative to said spring casing so that said first annular section of said first spring retainer means is moved into an out of engagement with said first flange;

a second spring retainer means mounted in said spring casing adjacent to said closed outer end thereof;

a sleeve-like member mounted on said rod member between said annular shoulder and the other end of said rod member and having a second annular flange extending radially outwardly from said sleeve-like member, said second annular flange constituting a third spring retainer means;

the part of said rod member between said shoulder and the inner end of said sleeve-like member extending through the central opening in said first spring retainer means for a limited axial movement relative to said first spring retainer means;

a positioning means on said rod member axially supporting said sleeve-like member at a predetermined position on said rod member so that the inner end of said sleeve-like member is spaced a predetermined distance from said annular shoulder;

a first compression coil spring means disposed in said spring casing and extending between said first annular section of said first spring retainer means and said second spring retainer means and biasing said first annular section of said first spring retainer means toward said first flange of said spring casing;

a second compression coil spring means disposed in said spring casing substantially coaxially with said first compression coil spring means and extending between said second annular section of said first spring retainer means and said second annular flange on said sleeve-like member and biasing said sleeve-like member away from said first spring retainer means;

the deformation of said diaphragm in one axial direction as caused by the decrease in the signal pressure beyond a first pressure level lower than the atmospheric pressure level causing said rod member to move with said first spring retainer means toward the closed outer end of said spring casing against said first compression coil spring means only to thereby advance the ignition timing of said engine;

the deformation of said diaphragm in the other axial direction as caused by the increase in the signal pressure beyond a second pressure level higher than the atmospheric pressure level causing said rod member to move with said sleeve-like member toward said first spring retainer means aginst said second compression coil spring means only to thereby retard the ignition timing of said engine; and means for limiting the stroke of said rod member in the ignition-timing advancing direction.

As will be seen from the statement of invention above, all the spring means in the pressure-responsive ignition timing controller according to the present invention are disposed within a spring casing provided on the side of the diaphragm remote from the distributor. Accordingly, the spring loads on the diaphragm can be finely adjusted or re-adjusted even after the ignition timing controller has been mounted on the distributor housing.

The above and other objects, features and advantages of the present invention will be made more apparent by the following description with reference to the accompanying drawings.

DESCRIPTION OF THE PREFERRED EMBODIMENTS

Figure 1:
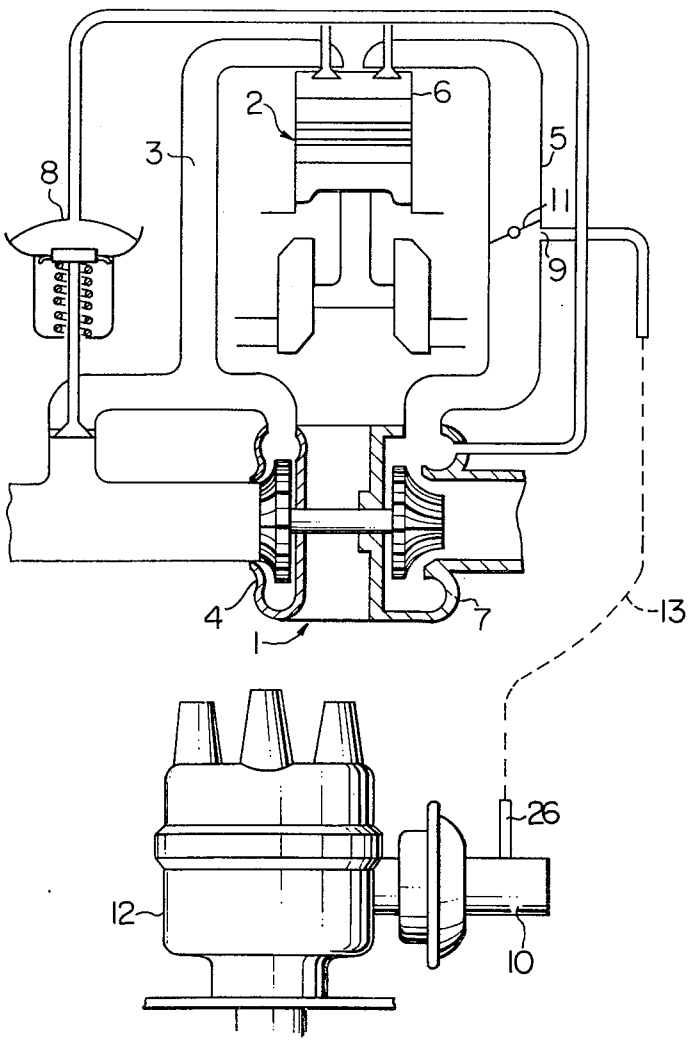
FIG. 1 is a diagrammatic illustration of a supercharged internal combustion engine equipped with an embodiment of a pressure-responsive ignition timing controller according to the present invention.

Before getting into the description of the preferred embodiments of the invention, a general description will be made hereinunder as to a supercharged internal combustion engine equipped with a turbo charger which is the most popular form of the supercharger, with specific reference to FIG. 1.

The turbo charger generally designated by a reference numeral 1 is composed of an exhaust gas turbine disposed in the exhaust gas passage 3 of the engine 2 and having a rotor adapted to be rotatively driven by the energy possessed by the flow of the exhaust gas, and a compressor 7 disposed in the intake passage 5 of the engine 2 and driven by the rotor of the exhaust gas turbine at the same speed to compress and force the intake air into the cylinders (one of which is shown by 6) of the engine 2.

Due to the supercharging effect provided by the turbo charger 1, the amounts of air charges to the cylinders 6 are increased to correspondingly increase the engine output to reduce the rate of fuel consumption. The supercharging effect usually becomes appreciable as the engine speed is increased beyond 2000 r.p.m. or so.

A reference numeral 8 denotes a waste gate for relieving the exhaust gas when the engine exhaust gas pressure has reached a predetermined value, to thereby maintain a constant supercharging pressure in the high speed region of the engine operation.

A reference numeral 12 denotes a distributor known per se, to which is attached a pressure-responsive ignition timing controller 10. The pressure-responsive ignition timing controller 10 is pneumatically connected by a conduit 13 to a pressure pickup port 9 provided at a portion of the intake passage 5 adjacent to a throttle valve 11.

The pressure at the pressure pickup port 9 takes a negative value, i.e., a level lower than the atmospheric pressure, in the low speed region in which there is no substantial supercharging effect, but takes a positive value as the supercharging is commenced. As a result, the pressure-responsive ignition timing controller 10 is subjected to a repetitional and drastic changes of pressure between negative and positive values. This gives rise to a demand for a pressure-resonsive ignition timing controller which advances the ignition timing when it receives a negative pressure and retards the ignition timing to avoid knock when it receives a positive pressure.

Figure 2:
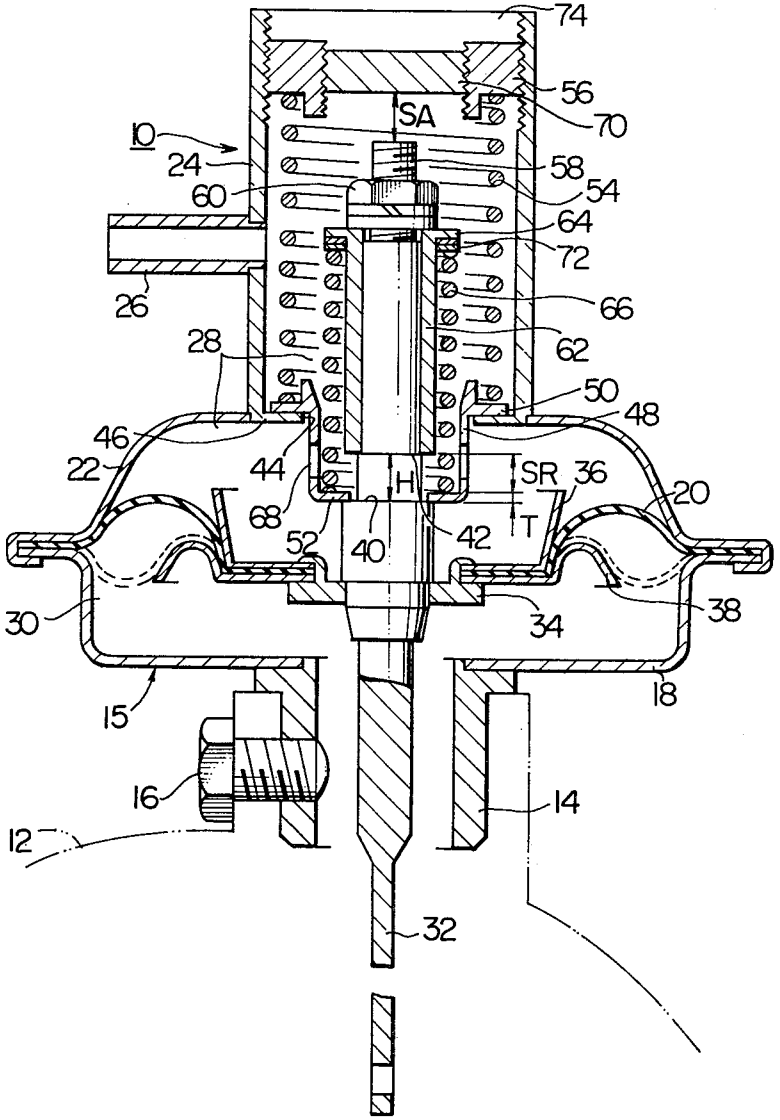
FIG. 2 is an enlarged axial sectional view of the pressure-responsive ignition timing controller shown in FIG. 1.
Figure 3:
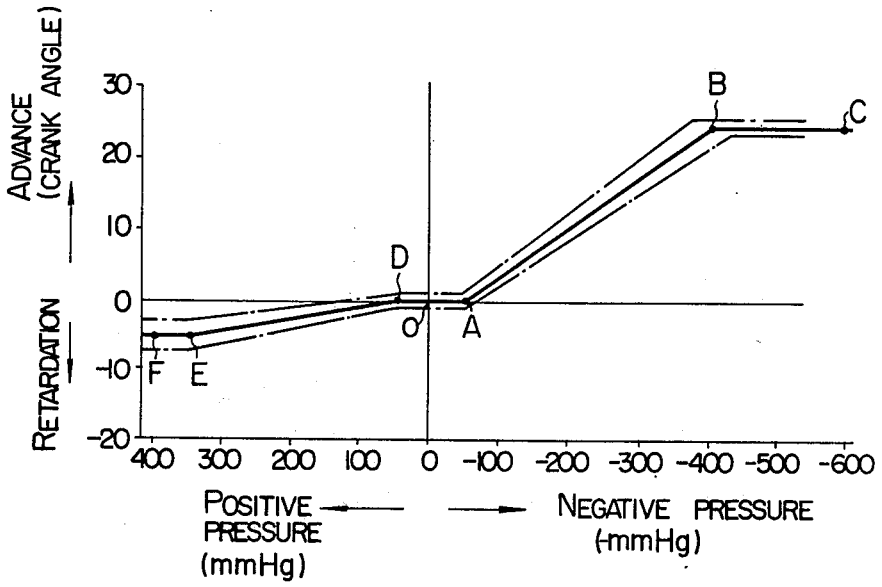
FIG. 3 graphically illustrates the ignition timing characteristic of the ignition timing controller shown in FIG. 2.

FIGS. 2 and 3 in combination show a pressure-responsive ignition timing controller constructed in accordance with an embodiment of the invention and the ignition timing characteristic thereof. Referring first to FIG. 2 showing the construction of the pressure-responsive ignition timing controller 10, the ignition timing controller 10 has a hollow boss portion or spigot 14 fastened to a distributor 12 by means of a bolt 16 or the like to fix the ignition timing controller 10.

To the spigot 14 is fixed a diaphragm housing 15 which is constituted by a saucer-shaped housing part 18 partly defining an atmospheric chamber and a housing part 22 which is fixed at its periphery to the housing part 18 in an air-tight manner with a diaphragm 20 clamped therebetween.

A spring casing 24 is fixed to the back side of the pressure chamber housing part 22. To the side wall of the spring casing 24 is fixed a mouth piece 26 which in turn is pneumatically connected by the conduit 13 to the pressure pick up port 9 provided in the intake passage 5 of the engine, as will be seen in FIG. 1. As will be described later, the space inside the spring casing 24 is pneumatically connected to the inside of the pressure chamber housing part 22, while the space in the atmospheric chamber housing part 18 is communicated with the atmosphere. Thus, the housing part 22, the spring casing 24 and the diaphragm 20 cooperate to define a pressure chamber 28 while the housing part 18 cooperates with the diaphragm 20 to define an atmospheric pressure chamber 30.

A reference numeral 32 denotes a rod which extends through the spigot 18 and through the central parts of the housing part 18 of the diaphragm 20 and of the housing part 22. The rod 32 is operatively connected at its one end to an ignition signal generator (not shown) incorporated in the distributor 12 while the other end (upper end as viewed in the drawing) of the rod is extended into the spring case 24. The ignition signal generator may include a breaker plate which is known per se.

The diaphragm 20 has a pair of fixing members 36, 38 which are positioned at the center of the diaphragm and are superposed thereto. These fixing members 36, 38 are caulked to a caulk ring 34 secured to an intermediate portion of the rod 32 by soldering or the like measure, to thereby fix the diaphragm 20 to the rod 32.

The portion of the rod 32 within the pressure chamber housing part 22 has a first annular step (shoulder) 40 and a second annular step (shoulder) 42 directed toward the outer end of the rod 32. A predetermined distance H is left between the first and the second steps 40, 42. On the other hand, an annular flange 46 extending radially inwardly and defining therein a central opening 44 is formed at a portion of the spring casing 24 jointed to the pressure chamber housing part 22.

A reference numeral 48 denotes a hollow cylindrical spring retainer which extends through the central opening 44 defined by the flange 46. The spring retainer 48 has a flange 50 extending radially outwardly and engaging the portion of the upper face of the aforementioned flange 46 around the central opening 44, and a flange 52 which extends radially inwardly to engage the aforementioned first step 40 of the rod 32.

A reference numeral 54 denotes a compression coil spring acting as an advancer spring. The advancer spring 54 is disposed between a spring load adjusting member (screw member) 56, which is in threadable engagement with the thread formed in the inner peripheral surface of the spring casing 24, and the radially outwardly extending flange 50 of the spring retainer 48 to bias the spring retainer 48 into engagement with the radially inwardly extending flange 46 of the spring case 24, as will be seen in FIG. 2.

A male screw thread 58 is formed on the outer end of the rod 32 remote from the distributor 12. A sleeve-like spring guide 62 is clamped between the second step 42 on the rod and a nut 60 screwed over the male screw thread 58. The lower end of the spring guide has a diameter greater than that of the central opening of the radially inwardly extending flange 52 of the spring retainer 48. A radially outwardly extending flange 64 is formed at the upper end of the spring guide 62.

A reference numeral 66 denotes a compression coil spring acting as a retarder spring. The retarder spring 66 is disposed between the radially outwardly extending flange 64 of the spring guide 62 and the radially inwardly extending flange 52 of the spring retainer 48.

The cylindrical portion of the spring retainer 48 is formed therein with openings 68 through which the space inside the spring casing 24 is communicated with the interior of the pressure chamber housing part 22, as discussed above.

The spring load adjusting member 56 screwed into the upper part of the spring casing 24 has an internal screw thread engaged by a stroke limiting member 70 adapted to limit the maximum stroke $S_A$ of the rod 32 in the advancing direction.

A predetermined number of thin washers 72 are interposed between the retarder spring 66 and the radially outwardly extending flange 64 of the spring guide 62. The thin washers constitute the load adjusting member for adjusting the set load of the retarder spring 66.

Since the retarder spring 66 is disposed between the spring retainer 48, which is loosely fitted over the rod 32, and the spring guide 62 fixed to the same rod 32, the annular surface of the first step 40 of greater diameter is pressed against the radially inwardly extending flange 52 formed at the lower end of the spring retainer 48 in the illustrated neutral state. Thus, the compression stroke of the retarder spring 66, i.e., the maximum stroke of the rod 32 in the ignition timing retarding direction, is equal to the difference between the distance H of the first step 40 of the rod from the lower end (same position as the second step 42) of the spring guide 62 and the thickness T of the radially inwardly extending flange 52, i.e., the distance $S_R$ shown in FIG. 2.

After the ignition timing controller 10 is mounted on the distributor 12 and the advance and retardation characteristic is adjusted, the spring load adjusting member 56 and the stroke limiting member 70 are adhered by means of adhesive and sealed in the opened upper end 74 of the spring casing 24.

The operation of the pressure-responsive ignition timing controller having the described construction operates in a manner described hereinunder with specific reference to FIG. 3.

FIG. 2 shows the pressure-responsive ignition timing controller 10 in the neutral position which is deviated neither in the advancing direction nor in the retarding direction, i.e., in the state represented by "0" in FIG. 3. As the pressure at the pressure pickup port 9 is lowered to a negative level, the pressure in the pressure chamber 28 is also reduced to the negative level. As the difference between this negative pressure and the pressure in the atmospheric chamber 30 exceeds the set load of the advancer spring 54, i.e., the point A in FIG. 3 which may be, for example, −50 mmHg, the diaphragm 20 is deformed or deflected toward the spring casing 24 to move the rod 32 in the advancing direction. In consequence, the rod 32 presses the radially inwardly directed flange 52 of the spring retainer 48 so that the advancer spring 54 is compressed between the radially outwardly extending flange 50 and the spring load adjusting member 56. Meanwhile, the retarder spring 66 is moved upward together with the rod 32 as a unit and thus is not compressed. The advance angle is gradually increased in accordance with the increase in the negative pressure with the balance between the magnitude of the negative pressure and the spring load of the advancer angle 54 being maintained. Namely, the ignition timing is moved from the point A to an advanced point B in FIG. 3. However, since the maximum stroke of the rod 32 in the advancing direction is limited by the limiting member 70, the advance of the ignition timing is stopped at the point B which corresponds, for example, to a negative pressure of −400 mmHg and an advance crank angle of 25°. In this state, the rod 32 has travelled its maximum stroke $S_A$. The maximum stroke $S_A$ is, for example, 5.7 mm when the advance angle is 25°. Thus, the characteristic of movement of the rod 32 in the advancing direction, i.e., the ignition timing advancing characteristic, is represented by a curve joining the points O, A, B and C successively. The negative pressure at the point C is, for example, −600 mmHg.

To the contrary, when the pressure in the intake pipe is increased to a positive value (pressure higher than the atmospheric pressure) to raise the pressure in the pressure chamber 28 also to a positive value, the pressure-responsive ignition timing controller 10 operates in the following manner:

The positive pressure in the pressure chamber 28 acts on the diaphragm 20 to invert and deflect the same toward the atmospheric pressure chamber housing part 18 as shown by broken lines. As this positive pressure is increased, the difference between the pressure in the pressure chamber 28 and the pressure in the atmospheric pressure chamber 30 is increased to reach a pressure corresponding to the set load value of the retarder spring 66, i.e., to a point D shown in FIG. 3 which corresponds, for example, to +50 mmHg. This differential pressure acts to deflect the diaphragm 20 toward the distributor 12, i.e., downwardly as viewed in the drawings, to displace the rod 32 in the retarding direction which is, in this case, the downward direction. More specifically, the spring guide 62 which is united with the rod 32 compresses the retarder spring 66 between itself and the radially inwardly extending flange 52 of the spring retainer 48. Meanwhile, the advancer spring 54 is maintained in the initially set condition because the spring retainer 48 is not moved. Thus, a relative movement occurs between the rod 32 and the spring 54. As the positive pressure is further increased, the rod 32 is moved in the retarding direction (i.e., downwardly as viewed in FIG. 2) with the balance being maintained between the spring load of the retarder spring 66 and the positive pressure, i.e., the difference between the pressure in the pressure chamber 28 and the atmospheric pressure. Thus, the ignition timing is shifted from the point D to a point E in FIG. 3. The maximum stroke of the rod 32 in the retarding direction is limited to the position at which the lower end of the spring guide 62 is engaged by the radially inwardly extending flange 52. Namely, the retardation of the ignition timing is limited to the point E in FIG. 3 where the positive pressure and the retardation are, for example, +350 mmHg and 5° in terms of the crank angle, respectively. The maximum stroke in the retarding direction is limited to $S_R$ which is, for example, 2.3 mm.

The characteristic of the movement of the rod 32 in the retarding direction, i.e., the ignition timing retardation characteristic of the controller 10, is given by a curve which joins the points O, D, E and F in FIG. 3. The positive pressure at the point F is equal to +400 mmHg, for example.

As will be understood from the foregoing description, the advancer spring 54 which acts in response to the negative pressure and the retarder spring 66 which act in response to the positive pressure operate independently of each other although they are disposed on the same side of the diaphragm 20, i.e., on the side of the diaphragm 20 remote from the distributor 12. It is, therefore, possible to adjust and set the ignition timing advance characteristic and retardation characteristic independently of each other by means of the advancer spring 54 and the retarder spring 66, respectively.

Tolerances are preserved for the advance and retardation characteristics as shown by one-dot-and-dash lines in FIG. 3. This tolerance, however, is extremely small due to the recent severe emission control regulation.

The gradient of the characteristic curve between the points A and B in FIG. 3 is determined by the spring constant of the advancer spring 54, while the gradient of the characteristic curve between the points D and E is determined by the spring constant of the retarding spring 66. Partly because the springs 54 and 66 can be fabricated with a sufficiently high precision of the spring constants and partly because these springs 54, 66 operate independently of each other, it is possible to relatively easily obtain the desired advance and retardation characteristics within the range of the above-mentioned tolerance.

However, the points A and D, at which the advance and retardation are started, as well as the points B and E of the maximum strokes may fail to fall within the required or predetermined ranges because these points largely depend upon the integration of dimensional errors of the associated mechanical parts. It is, therefore, necessary to make fine adjustments to the ignition timing controller after its mechanical components have been assembled. The adjustments can be made in the following manner:

The point A, i.e., the negative pressure level at which the advance of the ignition timing is commenced can be adjusted by varying the compression or deflection of the advancer spring 54, i.e., the set load of the advancer spring 54, by means of the spring load adjusting member 56 which is a screw member, while the point D, i.e., the positive pressure level at which the retardation of the ignition timing is commenced can be adjusted by varying the compression or deflection of the advancer spring 66, i.e., the set load of the advancer spring 66, by means of the thin washers 72. The maximum angle of the ignition timing advance, i.e., the maximum advance stroke $S_A$ to the point B can be adjusted by means of the stroke adjusting member 70 which is a screw member. Thus, the points A and B as well as the maximum angle of ignition timing advance can be adjusted easily and precisely by means of the respective adjust members discussed above.

On the other hand, the maximum angle of the ignition timing retardation, i.e., the maximum retardation stroke $S_R$ to the point E, does not need such a precise adjustment as one required for the maximum angle of ignition timing advance partly because the tolerance for the maximum angle of retardation is usually greater than that for the maximum angle of advance (in the illustrated embodiment of the invention, about twice as large as the tolerance for the maximum angle of advance) and partly because only a small number of mechanical component parts take part in the control of the maximum angle of retardation. In the described embodiment of the invention, however, it is possible, if necessary, to adjust the maximum angle of retardation easily and precisely by interposing a stroke adjusting washer or washers (not shown) between the retardation spring 66 and the radially inwardly extending flange 52 of the spring retainer 48.

As described above, the advancer spring 54, the retarder spring 66, the rod stroke limiting member and the spring load adjusting member of the illustrated embodiment of the invention are all disposed on the side of the diaphragm 20 remote from the distributor 12. This arrangement greatly facilitates easy and simplified attachment and detachment of these members as well as simplified and accurate readjustment and/or fine adjustment of the advance and retardation characteristic of the ignition timing controller 10 after it has been mounted on the distributor 12. Namely, it is possible to measure the advance and retardation characteristics of the ignition timing controller 10 after it has been mounted on the distributor 12 and, if it is found that the measured advance and retardation characteristics of the controller 10 do not fall within the predetermined range, it is easily possible to finely readjust the operation characteristics and/or replace some mechanical component parts. The ignition timing controller 10 has a simplified structure as a whole and provides improved, precise and reliable ignition timing advance and retardation characteristics. In addition, since the diaphragm is secured at its central portion to the rod 32 by caulking, the illustrated embodiment of the invention contributes to the reduction in the number of the necessary component parts as well as the improvements in the air-tightness and in the workability.

From the foregoing description, it will be understood that the present invention provides a pressure-responsive ignition timing controller for supercharged internal combustion engine which has a simple construction and affords easy and precise adjustments of the advance and retardation characteristics.

The parts of the embodiment similar to those of the preceding embodiment will be designated by similar reference numerals added by "a". The difference of the embodiment will be discussed hereunder.

The rod 32*a* lacks the second step 42 shown in FIG. 2, and the radially outwardly extending flange 64*a* of the spring guide 62*a* is set and tightened by means of a nut 60*a* to become fliush with the end step 15 of the rod 32*a*. As in the case of the first embodiment, the maximum stroke $S_R$ in the retarding direction is determined by the distance between the lower end of the spring guide 62*a* and the radially inwardly extending flange 52*a* of the spring retainer 48*a*.

This arrangement not only reduces the steps of process for working the rod but also makes it possible to cope with some extensive design change in respect of the angle of retardation and this is possible by merely changing the length of the spring guide 62*a*. Modification of the rod is unnecessary. For these reasons, the embodiment shown in FIG. 4 greatly contributes to the improvement in the productivity of the pressure-responsive ignition timing controller.

Figure 4:
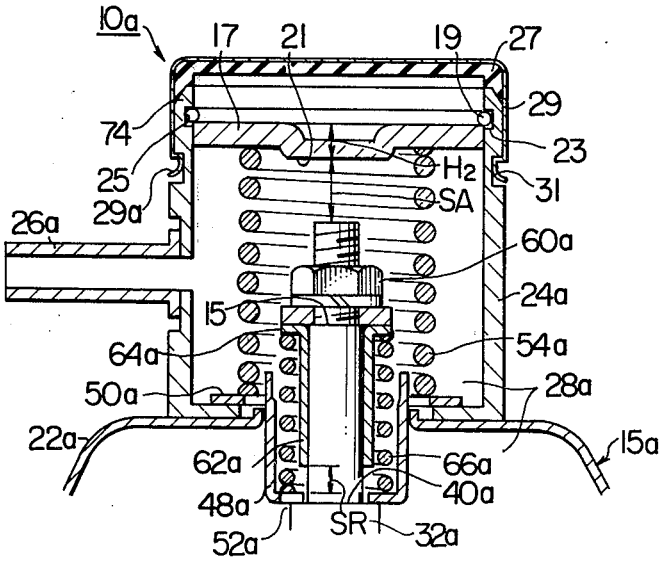
FIG. 4 is an enlarged fragmentary sectional view of a second embodiment of the pressure-responsive ignition timing controller of the present invention.

The spring load adjusting member 56 and the stoke limiting member 70, which are employed in the first embodiment shown in FIG. 2, are not provided in the spring casing 24*a* of the embodiment shown in FIG. 4. Instead, a second spring retainer 17 is fitted into and secured to the spring casing 24*a* by means of a snap ring 19 engaged in an annular groove 25 formed in the inner peripheral surface of the casing 24*a*.

The second spring retainer 17 is formed of a pressed material having a central protrusion 21 whose inner surface is offset a distance $H_2$ from the outer surface of the rest of the spring retainer 17. The maximum stroke of the rod 32*a* in the ignition timing advance direction is determined by the distance between the rod 32*a* and the inner surface of the protrusion 21 of the second spring retainer 17.

The described arrangement assures high precisions of manufacture of individual component parts and high precision of assembled structure and thus eliminates the necessity for the adjustment after the component parts are assembled, with a result that the productivity is remarkably improved.

In the case where the ignition timing controller thus made fails to provide an operation characteristic which falls within the predetermined range, fine adjustments can be made in the following manner:

The advance characteristic can be finely adjusted by interposing a thin washer (not shown) between the advancer spring 54*a* and the second spring retainer 17 to finely adjust the set load of the spring 54*a*. To finely adjust the maximum stroke $S_A$ of the rod 32*a* in the advance direction, the second spring retainer 17 may be replaced by another spring retainer having a different height $H_2$ of the protrusion 21.

The retardation characteristic can be adjusted by placing a thin washer (not shown) between the retarder spring 66*a* and the flange 64*a* of the spring guide 62*a* to finely adjust the set load of the spring 66*a*. To finely adjust the maximum stroke $S_R$ of the rod 32*a* in the retarding direction, the spring guide 62*a* may be replaced by another one having a slightly different length.

A cap 27 made of rubber or a similar resilient material is fitted over the upper open end 74 of the spring casing 24*a* and fixed to the same by means of a clamp 29 made of a resilient material such as a leaf spring. The clamp 29 has clicks 29*a* engaged in a groove 31 formed in the outer peripheral surface of the spring casing 24*a*.

This arrangement eliminates the necessity for such an adhesive as is employed in the first embodiment of the invention and thus greatly contributes to the productivity of the ignition timing controller.

Figure 6:
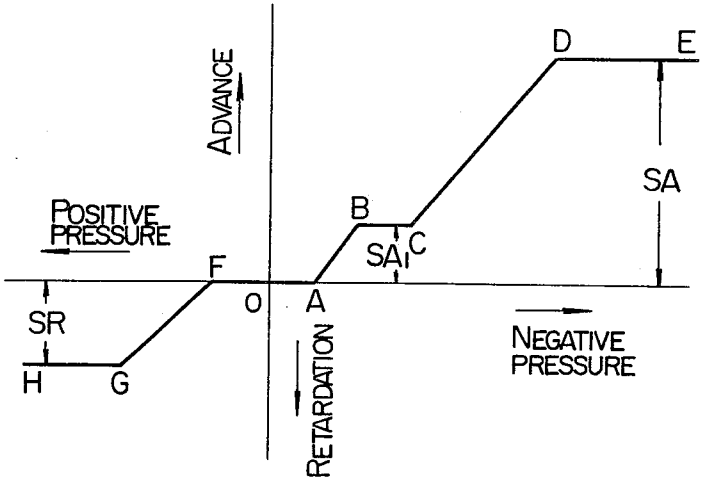
FIG. 6 graphically illustrates the ignition timing characteristic of the ignition timing controller shown in FIG. 5.

A third embodiment of the invention will be described with reference to FIGS. 5 to 7. This embodiment is suited for providing a two-stage advancing characteristic by which the ignition timing is initially advanced a predetermined angle to improve the fuel consumption during idle operation of the engine. This embodiment is distinguished from the preceding embodiment solely in respect of the advancer spring mounting structure which will be described hereunder. The parts of the embodiment similar to those of the preceding embodiment are designated by similar reference numerals.

An advancer spring guide 81 has a generally frustoconical shape and has a radially inwardly extending flange 81, a radially outwardly extending flange 82 and a cylindrical portion 83 extending axially of the rod 32*a* from the radially outwardly extending flange 82. The radially inwardly extending flange 81 defines a central opening 84 through which the outer end portion of the rod 32*a* extends for axial movement.

A first advancer spring 85 is interposed between the radially inwardly extending flange 81 of the advancer spring guide 80 and the radially outwardly extending flange 50*a* of the spring retainer 48*a* to urge the radially outwardly extending flange 50*a* of the spring retainer 48*a* against the radially inwardly extending flange 46*a* of the spring casing 24*a*.

A second advancer spring 86 is interposed between the second spring retainer 17 and the radially outwardly extending flange 82 of the advancer spring guide 80 to urge the same against the radially inwardly extending flange 46*a* of the spring casing 24*a*.

The cylindrical portion 83 of the advancer spring guide 80 has a height which is equal to the sum of the stroke $S_{A1}$ to the turning point of the first stage of the advance characteristic and the thickness of the radially outwardly extending flange 50*a* of the spring retainer 48*a*.

The operation of this embodiment will be described with reference to FIG. 6 first on the basis of an assumption that the pressure in the pressure chamber 28*a* is of a negative value.

As the negative pressure in the pressure chamber 28*a* is increased beyond a point A, the rod 32*a* is moved upward to lift the spring retainer 48*a* against the first advancer spring 85 until a point B is reached which corresponds to a position in which the radially outwardly extending flange 50*a* of the spring retainer 48*a* is engaged by the radially outwardly extending flange 82 of the advancer spring guide 80. Since the spring load of the second advancer spring 86 is set to be greater than the spring load of the first advancer spring 85, the increase in the negative pressure from the point B to a point C does not cause any axial movement of the rod 32*a*. Then, as the negative pressure is increased beyond the point C, the rod 32*a* is lifted against the second advancer spring 86 until a point D is reached, where the upper end of the rod 32*a* is engaged by the second spring retainer 17. Any further increase in the negative pressure from the point D to a point E cannot cause any further axial movement of the rod 32*a*. Meanwhile, the first advancer spring 85 is fixed between the spring retainer 48*a* and the advancer spring guide 80. In addition, retarder spring 66*a* is not compressed during the advancing operation and is moved in unison with the rod 32*a*.

On the other hand, as the pressure in the pressure chamber 28*a* is increased to a positive pressure level higher than the atmospheric pressure in the atmospheric pressure chamber 30*a*, the diaphragm 20*a* is inverted into the atmospheric pressure chamber 30*a* to drive the rod 32*a* downwardly. Namely, the spring guide 62*a* receiving the rod 32*a* therein compresses the retarder spring 66*a*, so that the ignition timing is retarded along a curve F–G. The rod 32*a* is lowered a distance $S_R$ until the lower end of the spring guide 62*a* is brought into contact with the radially inwardly extending flange 52 of the spring retainer 48*a*. Thereafter, the angle of retardation is kept constant and the ignition timing remains on the line G–H even if the positive pressure level is increased further. In this retardation operation, the advancer springs 85 and 86 are not compressed because the advancer spring guide 80 and the spring retainer 48*a* are kept stationary.

As described, the advancing movement of the rod 32*a* in the first stage is effective to compress the first advancer spring 85 and shift the ignition timing along the line A–B, while the advancing movement of the rod in the second stage is effective to compress the second advancer spring 86 and shift the ignition timing along the line C–D. In the retardation operation, the movement of the rod 32*a* in the retarding direction is effective to compress the retarder spring 66*a* and vary the ignition timing along the line F–G. These advancing and retarding operations take place independently to provide independent advance characteristic curve A–B–C–D–E and retardation characteristic curve F–G–H.

The position of the point A can easily be adjusted by inserting a thin washer (not shown) between the first advancer spring 85 and the radially inwardly extending flange 81 of the advancer spring guide 80. Similarly, the position of the point C can be adjusted by placing a thin washer (not shown) between the second advancer spring 86 and the radially outwardly extending flange 82.

The stroke length $S_{A1}$ to the point B of the advance characteristic does not necessitate any adjustment because it can be determined with a sufficiently high precision by the height of the cylindrical portion 83 of the advancer spring guide 80.

From the foregoing description, it will be seen that the pressure-responsive ignition timing controller of the described embodiment exhibits an advancing characteristic with two turning points and a retardation characteristic with a single turning point and is operative to automatically adjust the ignition timing in accordance with the pressure in the intake pipe of the associated supercharged internal combustion engine. In addition, because all the adjusting mechanisms are disposed in the pressure chamber, the pressure-responsive ignition timing controller can be of a compact design and, in addition, the change of the number of the spring load adjusting washers and the installation and replacement of the springs as well as all the adjustments of the controller are advantageously facilitated and simplified.

Figure 7:
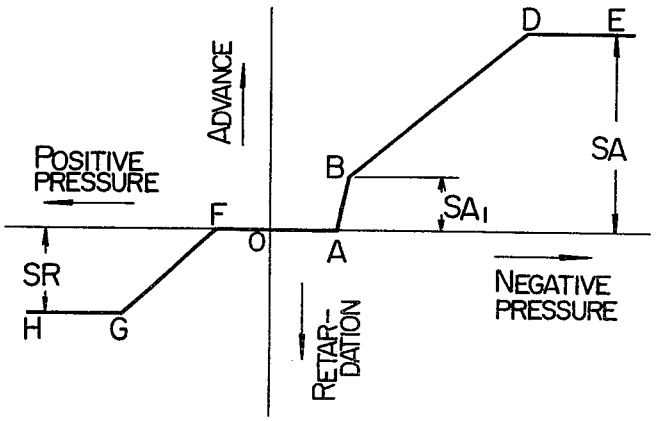
FIG. 7 is a view similar to FIG. 6 but illustrates the ignition timing characteristic of an ignition timing controller which is a modification of the ignition timing controller shown in FIG. 5.
Figure 5:
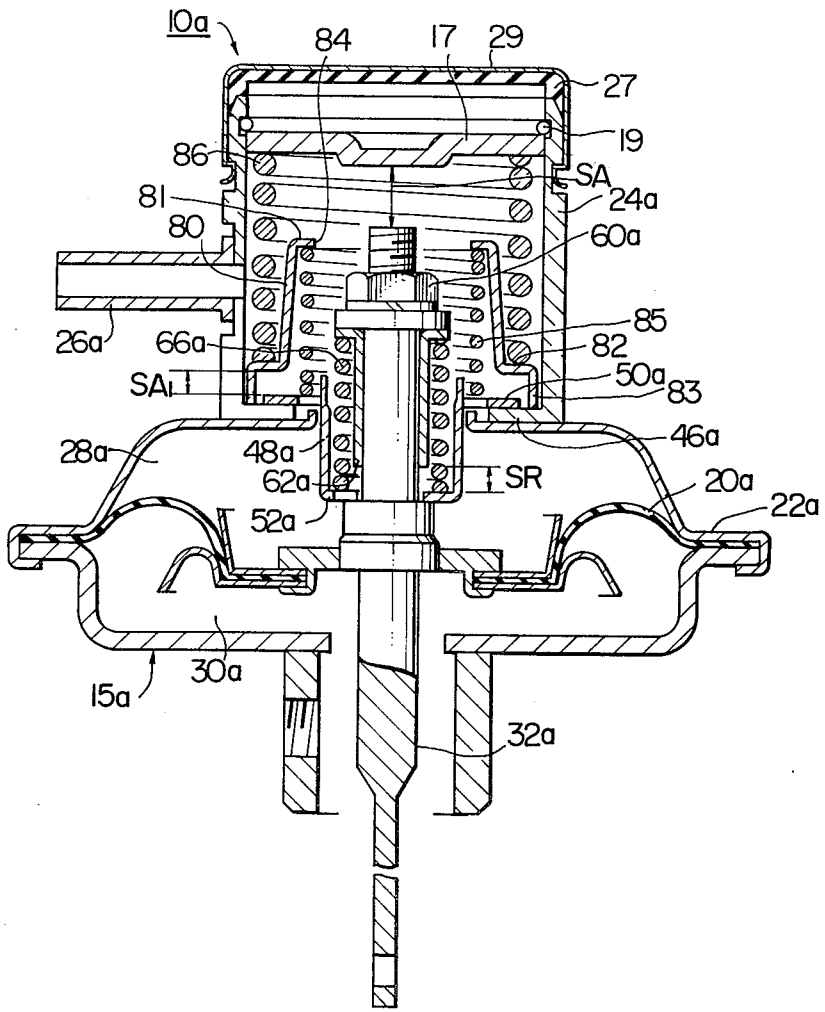
FIG. 5 is an enlarged sectional view of a third embodiment of the pressure-responsive ignition timing controller according to the present invention.

FIG. 7 shows the operation characteristic of a pressure-responsive ignition timing controller which is a modification of the embodiment shown in FIG. 5. In this modification, the set load of the second advancer spring 86 is so selected as to be equal to the load provided by the first advancer spring 86 when it is in the maximum compression state, so that the characteristic curve is turned at the point B to provide a linear line between the point B and the point D and the rod 32*a* is moved upwards by the increase in the negative pressure without any interruption. This arrangement provides an advantage that the angle of the characteristic curve at the turning point B can be precisely controlled.

What is claimed is:

1. A pressure-responsive ignition timing controller for a supercharged internal combustion engine having a distributor with an ignition signal generating means, comprising:

a diaphragm housing comprising first and second parts secured together along the peripheral edges thereof and having end walls formed therein with substantially coaxial openings, said first part being secured to said distributor;

a diaphragm disposed in said diaphragm housing and cooperative with said first diaphragm housing part to define a first chamber communicated with the atmosphere;

a generally tubular spring casing having a closed outer end and an open inner end with a radially inwardly extending first annular flange defining a central opening therein, the inner end of said spring casing being secured in air-tight manner to the end wall of said second diaphragm housing part so that said central opening in said spring casing is substantially coaxial with the opening in said second diaphragm housing part;

said second diaphragm housing part, said diaphragm and said spring casing cooperating together to define a second chamber pneumatically connected to the intake passage of said engine adjacent to the engine throttle valve so that a signal pressure is applied to said diaphragm;

an elongated rod member axially extending through said diaphragm housing and said spring casing and operatively associated at one end with said ignition signal generating means, said rod member being secured at an intermediate portion to said diaphragm so that said rod is axially movable with said diaphragm when the same is axially deformed by the pressure change in said second chamber, the other end of said rod being disposed in said spring casing, said rod member having an annular shoulder formed thereon between said diaphragm and the other end of said rod and directed toward said other end;

a first spring retainer means mounted in said spring casing adjacent to the inner end thereof and having a radially outwardly extending first annular section and a radially inwardly extending second annular section defining therein a central opening substantially coaxial with the opening in said inner end of said spring casing, said first spring retainer means being axially movable relative to said spring casing so that said first annular section of said first spring retainer means is moved into and out of engagement with said first flange;

a second spring retainer means mounted in said spring casing adjacent to said closed outer end thereof;

a sleeve-like member mounted on said rod member between said annular shoulder and the other end of said rod member and having a second annular flange extending radially outwardly from said sleeve-like member, said second annular flange constituting a third spring retainer means;

the part of said rod member between said shoulder and the inner end of said sleeve-like member extending through the central opening in said first spring retainer means for a limited axial movement relative to said first spring retainer means;

a positioning means on said rod member axially supporting said sleeve-like member at a predetermined position on said rod member so that the inner end of said sleeve-like member is spaced a predetermined distance from said annular shoulder;

a first compression coil spring means disposed in said spring casing and extending between said first annular section of said first spring retainer means and said second spring retainer means and biasing said first annular section of said first spring retainer means toward said first flange of said spring casing;

a second compression coil spring means disposed in said spring casing substantially coaxially with said first compression coil spring means and extending between said second annular section of said first spring retainer means and said second annular flange on said sleeve-like member and biasing said sleeve-like member away from said first spring retainer means;

the deformation of said diaphragm in one axial direction as caused by the decrease in the signal pressure beyond a first pressure level lower than the atmospheric pressure level causing said rod member to move with said first spring retainer means toward the closed outer end of said spring casing against said first compression coil spring means only to thereby advance the ignition timing of said engine;

the deformation of said diaphragm in the other axial direction as caused by the increase in the signal pressure beyond a second pressure level higher than the atmospheric pressure level causing said rod member to move with said sleeve-like member toward said first spring retainer means against said second compression coil spring means only to thereby retard the ignition timing of said engine; and means for limiting the stroke of said rod member in the ignition-timing advancing direction.

2. A pressure-responsive ignition timing controller as defined in claim 1, wherein said first compression coil spring means comprises a single compression coil spring member.

3. A pressure-responsive ignition timing controller as defined in claim 1 or 2, wherein said second spring retainer means comprises an externally threaded annular member adjustably screwed into internally threaded outer end portion of said spring casing and said stroke limiting means comprises a circular member adjustably screwed into the threaded opening defined in said second spring retainer means.

4. A pressure-responsive ignition timing controller as defined in claim 1 or 2, wherein said second spring retainer means comprises a circular member fitted into the outer end of said spring casing and axially supported by a snap ring member engaged with an annular groove formed in the inner peripheral surface of said spring casing adjacent the outer end thereof, the central zone of said circular member constituting said stroke limiting means.

5. A pressure-responsive ignition timing controller as defined in claim 1 or 2, wherein said rod member is provided with a second annular shoulder formed thereon between said first annular shoulder and the outer end of said rod and directed toward the outer end of said spring casing, and said positioning means includes a nut screwed over the other end of said rod member to hold said sleeve-like member against said second annular shoulder, said second shoulder being spaced said predetermined distance from first-said annular shoulder.

6. A pressure-responsive ignition timing controller as defined in claim 1 or 2, wherein said rod member is provided with a second annular shoulder spaced from said first annular shoulder a distance and directed toward said outer end of said spring casing, and said positioning means includes an annular ring-like member on said rod member and a nut screwed over the other end of said rod member to hold said annular ring-like member against said second annular shoulder.

7. A pressure-responsive ignition timing controller as defined in claim 1, wherein said first compression coil spring means comprises a pair of compression coil spring members and a link member disposed therebetween.

8. A pressure-responsive ignition timing controller as defined in claim 7, wherein said link member is generally tubular and has radially inwardly and outwardly extending annular sections adjacent to the opposite ends of said link member, respectively, one of said pair of compression coil spring members extends between said first annular section of said first spring retainer means and the radially inwardly extending annular section of said link member while the other of said pair of compression coil spring members is disposed in axially overlapped relationship to said one compression coil spring member and extends between the radially outwardly extending annular section of said link member and said spring retainer means.

9. A pressure-responsive ignition timing controller as defined in claim 7 or 8, wherein said pair of compression coil spring members have different spring forces.

10. A pressure-responsive ignition timing controller as defined in claim 1, 2 or 7, wherein said first spring retainer means comprises a single member including a substantially cylindrical section extending through the central opening in the inner end of said spring casing, said first annular section of said first spring retainer means extending from said cylindrical section adjacent to the end thereof remote from said diaphragm while said second annular section of said first spring retainer means extends from said cylindrical section adjacent to the end thereof adjacent to said diaphragm.

* * * * *